US006834816B2

(12) United States Patent
Kah, Jr.

(10) Patent No.: US 6,834,816 B2
(45) Date of Patent: Dec. 28, 2004

(54) SELECTED RANGE ARC SETTABLE SPRAY NOZZLE WITH PRE-SET PROPORTIONAL CONNECTED UPSTREAM FLOW THROTTLING

(76) Inventor: Carl L. C. Kah, Jr., 11517 Turtle Beach Rd., Lost Tree, North Palm Beach, FL (US) 33408

( * ) Notice: Subject to any disclaimer, the term of this patent is extended or adjusted under 35 U.S.C. 154(b) by 0 days.

(21) Appl. No.: 10/207,521

(22) Filed: Jul. 25, 2002

(65) Prior Publication Data

US 2003/0075620 A1 Apr. 24, 2003

Related U.S. Application Data

(60) Provisional application No. 60/307,686, filed on Jul. 25, 2001.

(51) Int. Cl.[7] ..... B05B 1/32

(52) U.S. Cl. ..... 239/451; 239/457; 239/456; 239/537; 239/518

(58) Field of Search ..... 239/451, 457, 239/456, 537, 538, 539, 541, 518, 521, 523, 524, 575

(56) References Cited

U.S. PATENT DOCUMENTS 556,036 A * 3/1896 Washburn ..... 213/147
3,645,451 A * 2/1972 Hauser ..... 239/206
4,189,099 A * 2/1980 Bruninga ..... 239/200
4,579,285 A * 4/1986 Hunter ..... 239/457
4,739,934 A * 4/1988 Gewelber ..... 239/446
4,932,590 A * 6/1990 Hunter ..... 239/222.17
4,967,961 A * 11/1990 Hunter ..... 239/240
5,031,840 A * 7/1991 Grundy et al. ..... 239/456
5,050,800 A * 9/1991 Lamar ..... 239/201
5,148,990 A * 9/1992 Kah, Jr. ..... 239/222.17
5,215,254 A * 6/1993 Haruch ..... 239/107
5,322,223 A * 6/1994 Hadar ..... 239/457
5,588,594 A * 12/1996 Kah, Jr. ..... 239/107
5,642,861 A * 7/1997 Ogi et al. ..... 239/568
5,695,123 A * 12/1997 Le ..... 239/259
5,845,849 A * 12/1998 Mitzlaff ..... 239/203
6,019,295 A * 2/2000 McKenzie ..... 239/451
6,145,758 A * 11/2000 Ogi et al. ..... 239/457
6,158,675 A * 12/2000 Ogi ..... 239/396
6,264,117 B1 * 7/2001 Roman ..... 239/203

* cited by examiner

*Primary Examiner*—Henry Bennett
*Assistant Examiner*—Amanda Flynn
(74) *Attorney, Agent, or Firm*—Ostrolenk, Faber, Gerb & Soffen, LLP

(57) ABSTRACT

A selected range arc settable spray nozzle with pre-set table precipitation rate in which the arc of coverage adjustment is coupled to an upstream flow throttling valve. As the arc of coverage is adjusted, the opening of the upstream flow throttling valve is proportionally adjusted to maintain the precipitation rate substantially constant independent of arc of coverage adjustments. Upstream flow throttling achieved by use of pre-selected number of larger slots for desired flow whose opening area is varied as the arc is being set. The precipitation rate is set by adjusting the throttling valve to provide the desired flow rate for the maximum arc of coverage setting. A pressure compensating valve may also be provided.

19 Claims, 2 Drawing Sheets

SELECTED RANGE ARC SETTABLE SPRAY NOZZLE WITH PRE-SET PROPORTIONAL CONNECTED UPSTREAM FLOW THROTTLING

CROSS REFERENCE TO RELATED APPLICATION

This application is based on and claims benefit of U.S. Provisional Patent Application No. 60/307,686 filed Jul. 25, 2001 entitled SELECTED RANGE ARC SETTABLE SPRAY NOZZLE WITH PRE-SET PROPORTIONAL CONNECTED UPSTREAM FLOW THROTTLING, the disclosure of which is hereby incorporated by reference and to which a claim of priority is hereby made.

BACKGROUND OF THE INVENTION

1. Technical Field

This invention relates to adjustable arc of coverage spray nozzles, and more particularly, to such nozzles which have preset spray ranges, and in which an upstream throttling valve is proportionally mechanically coupled to the arc of coverage adjustment so that a substantially constant precipitation rate can be selected and provided as the arc of coverage is adjusted. The invention also relates to sprinkler systems including a plurality of such nozzles with different spray ranges.

2. Relevant Prior Art

Sprinkler nozzles are known which have an adjustable arc of coverage, e.g., as shown in Hunter U.S. Pat. No. 4,579,285, and in my U.S. Pat. No. 5,588,594.

My U.S. patent application Ser. No. 10/100,259 entitled SPRAYNOZZLE WITH ADJUSTABLE ARC SPRAY ELEVATION ANGLE AND FLOW, filed Mar. 15, 2002 discloses an adjustable range and arc of coverage nozzle having an adjustable arcuate spray slot in which the arc setting mechanism is linked to an upstream throttling valve to proportionally control the flow to the spray slot as the arc of spray coverage is increased or decreased. Although other arc-settable spray nozzles that have adjustable upstream throttling valves are also known, the upstream throttling valve areas of these are not preset at the factory during assembly to provide the correct flow rate for the desired range of coverage while still maintaining the same larger adjustable slot width, and if adjusted, are not designed to provide proportionally increasing area openings as the arc of coverage is increased for substantially uniform precipitation independent of the arc of coverage setting.

The short range adjustable arc nozzles which are now on the market have adjustable arcuate slot orifices that are quite thin e.g., less than 0.030 inch, to reduce the flow rates for the shorter ranges of coverage such as 8 feet. These very thin slots are easily clogged and require fin filters having correspondingly small openings, which themselves are easily clogged.

There is accordingly a need for an improved adjustable arcuate slot nozzle in which an upstream proportional flow rate adjusting valve and an arc of coverage adjustment mechanism are coupled so that a substantially constant pre-settable precipitation rate is obtained for different arcs of coverage when the desired flow rate is less than what the adjustable arcuate slot alone provides. The present invention seeks to address this need, in addition to having the nozzles preset at the factory to provide selected shorter ranges of coverage such as 8, 10, 12, and 15 feet.

SUMMARY OF THE INVENTION

According to this invention, a simple arc-settable spray nozzle may have a relatively large adjustable arc spray slot width (e.g., at least 0.030 in.) for even short range nozzle configurations. Also, by proportionally throttling the flow upstream of the adjustable arc slot, the width of the open area of the arcuate slot can be substantially constant and uniform, independent of the arc setting. The upstream valve can be formed of one or more relatively large axial-width openings which concentrate the flow area in larger size grooves of a selected shape to proportionately open or close the flow area as the upstream throttling valve member is moved axially during setting of the desired arc of coverage. Since the upstream flow is concentrated into a small number of openings or grooves while still providing significant throttling, the adjustable arcuate spray slot may now have a greater opening size while still providing the desired lower flow rate for the short range nozzles.

As the arc opening of the adjustable arcuate spray slot is varied by rotation of a spray nozzle deflector and flow control member, a coupled throttling valve element varies the area of the upstream openings. Due to the configuration of the upstream openings, and other parts, the throttling is proportional to the arc opening of the arcuate spray slot.

Also, a pressure compensating configuration is disclosed in which one member of the upstream throttling valve is made of a flexible material so that it is pressure responsive. Thus, if the inlet pressure increases, the throttling valve flow area is reduced to compensate for the pressure change.

It is accordingly an object of the present invention to provide an improved adjustable arc of coverage sprinkler nozzle.

It is another object of the present invention to provide an improved adjustable arc of coverage sprinkler nozzle in which an upstream flow rate adjusting valve provides proportional adjustment to match the rotational and axial movement of the coupled arc of coverage adjustment mechanism so that a substantially constant precipitation rate is obtained for different arcs of coverage, even when the flow rate is preadjusted to be less than would flow from the adjustable arcuate slot alone to provide for the same precipitation rate.

It is yet another object of the present invention to provide an improved adjustable arc of coverage sprinkler nozzle in which an upstream flow rate adjusting valve and an arc of coverage adjustment mechanism can be pre-set, for example, during assembly at the factory, to provide a substantially constant pre-selected precipitation rate for different arcs of coverage, and in which different maximum-flow settings of the upstream flow rate adjusting valve are provided for different ranges of coverage.

It is a further object of the present invention to provide an improved adjustable arc of coverage sprinkler nozzle with a coupled upstream flow rate adjusting valve and different configurations for different ranges of coverage in which the short range valve configurations are less subject to contamination by dirt than in conventional nozzles.

Another object of the invention is to provide a fixed range spray nozzle in which the exit elevation angle of the nozzle flow control deflector determines the spray range and the precipitation rate may be adjusted with an upstream flow control valve whose flow rate is proportionally controlled by a mechanical linkage with the arc of coverage setting mechanism for the adjustable arc of coverage slot.

So that the nozzle can be used for different spray ranges as part of a sprinkler system, the flow control mechanism includes an interchangeable deflector that determines the range, and the maximum flow rate for an upstream throttling valve is preset to match the selected range by prepositioning a movable valve member relative to a plurality of axial outlet orifice slots which concentrate the flow out of the throttling valve, and are configured to provide the required proportional flow adjustability. This construction allows use of outlet slots that are large enough to minimize the risk of obstruction by dirt for even the smallest range nozzle.

In a second embodiment, the flow throttling valve body is formed by a resilient diaphragm that includes one or more axial outlet orifice slots. The diaphragm includes a folded area that deflects in response to increased inlet water pressure, and thereby reduces the area of the outlet opening. By properly selecting the thickness and rigidity of the folded area, the changes in the size of the outlet opening can compensate for pressure variations and thus help keep the flow more constant at elevated inlet pressures.

Other features and advantages of the present invention will become apparent from the following description of the invention which refers to the accompanying drawings.

DETAILED DESCRIPTION OF THE INVENTION

Figure 1:
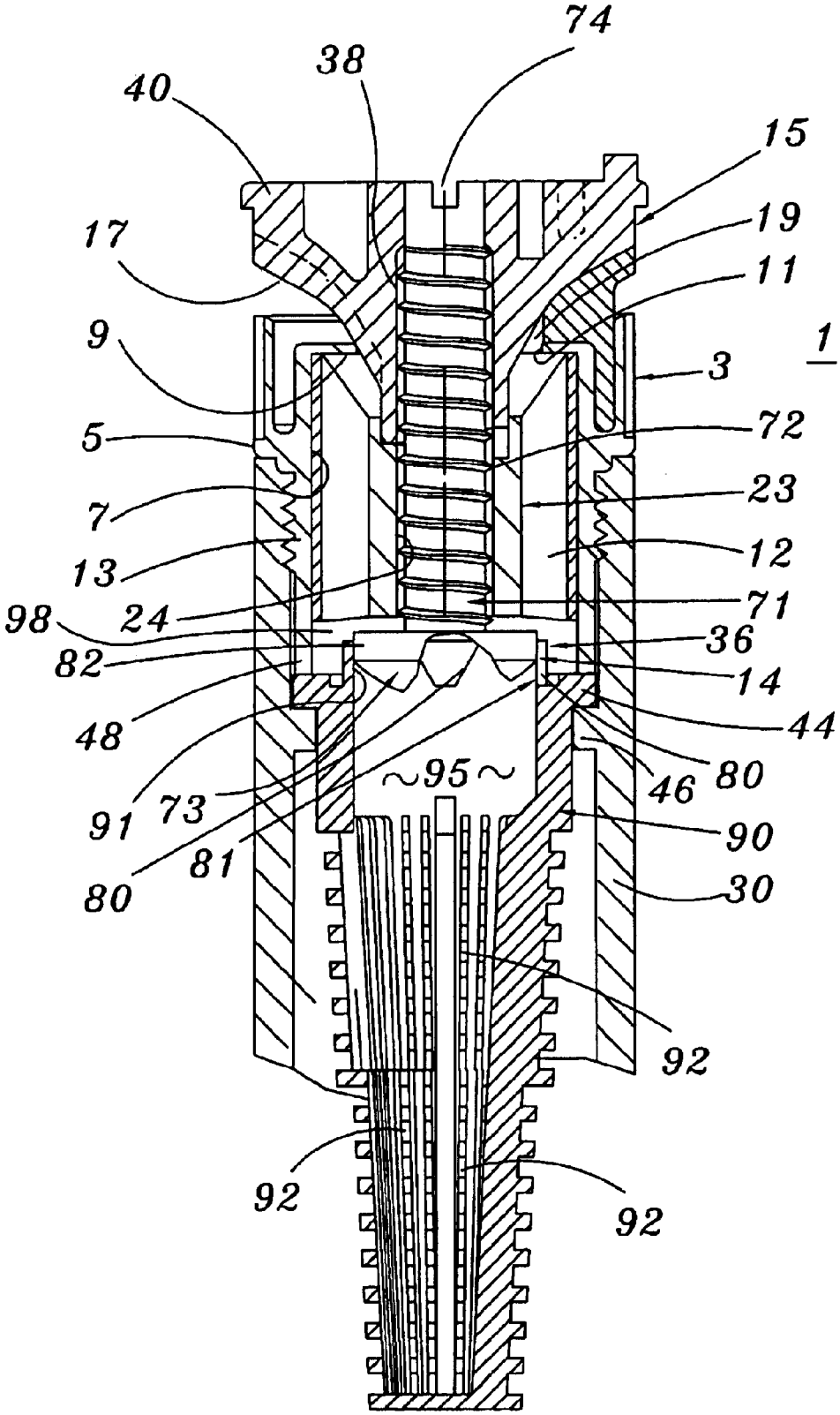
FIG. 1 is a cross-sectional view of a first embodiment of an adjustable arc spray nozzle according to the invention, including the upstream throttling valve and a matching filter mounted on a partial sprinkler riser tube.

Referring to FIG. 1, a first embodiment of an adjustable arc of coverage spray nozzle according to this invention, generally indicated at 1, is comprised of a cylindrical housing 3, a central body insert 23, an adjustable arc-of-coverage flow control member 15, an upstream flow throttling valve assembly 36, and a rotatable and axially movable central adjusting shaft 71 with a valving head 73 at its lower end, and an adjusting slot 74 at its upper end.

Cylindrical housing 3 is comprised of a generally circular outer wall 5 that defines an internal cavity 7, an outlet end closure top wall 9, the latter including a radically spiraled opening 11 that forms an arcuate water discharge orifice or spray slot, and a downwardly depending externally threaded skirt portion 13 that couples the nozzle to a conventional riser tube 30, by which pressurized water for the sprinkler may be supplied.

A filter 90 is positioned within riser tube 30, and is retained by a shoulder portion 44 that is held between a complementary shoulder 46 on the inside of tube 30 and the bottom end 48 of skirt portion 13 of housing 3. Filter 90 is of generally conventional construction, and includes a plurality of filter openings 92 through which water flows into an inner cavity 95 at its downstream or top end.

Cavity 95 functions as a valve housing or body for flow throttling valve assembly 36, as described below.

Body insert 23 is positioned in central cavity 7 of housing 3, and is supported therein by circumferentially spaced axial ribs 12. These can be integrally molded with insert 23; alternatively, a separate spacer including ribs 12 may be positioned in cavity 7 around insert 23.

Flow adjusting shaft 71 includes a threaded body portion 72, a valve adjusting member 73 at its lower end, and an adjustment slot 74, or the like, at the top.

The upper end of flow control adjusting shaft body portion 72 is received in an internally threaded central bore 38 in a body portion 40 of the arc-of-coverage flow control member 15. The portion of adjusting shaft body 72 that extends below flow control member body 40 is threadedly received in an internally threaded central bore 24 in body insert 23.

The fit between adjusting shaft body 72 and central bore 24 is such that shaft 71 is rotationally and axially movable within bore 24, while the frictional fit between bore 38 and adjusting shaft body 72 is sufficiently tight that deflector body 40 and adjusting shaft 71 normally move together. Thus adjusting shaft 71 moves axially within bore 24 as deflector body 40 is manually rotated to adjust the arc of coverage.

The deflector body 40 includes a sloped axially spiraled surface 17 which cooperates with the radially spiraled housing slot 11 to provide a sealable variable-arc exit opening 19 that is rotationally adjustable from approximately zero to 360 degrees. The slope of deflector body 40 also determines the exit angle of the water stream through exit opening 19, and therefore, the range of the nozzle. Further details of the construction and operation of the adjustable arcuate orifice spray nozzle is provided in commonly owned U.S. Pat. No. 5,588,594, the content of which is incorporated herein by reference as if fully set forth.

Throttling valve member 73 mounted on the lower end of adjusting shaft 71 cooperates with a cavity 95 at the top of filter 90 to form flow throttling valve assembly 36. Throttling valve member 73 may be formed separately or as an integral part of adjusting shaft 71. Likewise, the flow valve housing may also be created as a cylindrical skirt depending from the bottom of spray nozzle housing insert 23. The interior wall 91 of cavity 95 includes a downstream outlet orifice region defined by a plurality of axial slots or shaped flow openings 80 which communicate with the lower end 98 of housing cavity 7. The outside circumference of throttling valve member portion 82 can be a 1:1 fit with interior wall 91 of the filter cavity 95.

As adjusting shaft 71 moves axially due to rotation of deflector body 40, throttling valve member 73 moves up or down within cavity 95. This progressively uncovers (or covers) slots 80, and changes the flow area and thus the flow rate of valve 36. After the water flows through outlet slots 80, it then flows axially upward through passages formed between insert 23 supporting ribs 12, and through cavity 7 to exit orifice 19.

As will be appreciated by those skilled in the art, the precise configuration of outlet slots 80, which may have an axially varying width, can be selected in coordination with the configurations of deflector body 40 and arcuate slot 11, and the pitch of tread 72 to produce desired flow rate variations as valve member 73 moves with shaft 71. According to this invention, these selections are made so that manual adjustment of the arc of coverage (by rotating deflector body 40) produces a proportional change in the flow area of throttling valve 36.

Because of this proportional adjustment, the flow through nozzle opening 19 is substantially constant independent of arc adjustment, and the desired substantially constant precipitation rate can be maintained.

As will further be appreciated by those skilled in the art in light of the disclosure herein, the axial position of valve member 73 when slot deflector body 40 is adjusted relative to slot 11 for the maximum arc of coverage determines the maximum flow rate, and therefore the precipitation rate.

This remains fixed because adjusting shaft 71 rotates with deflector body 40.

However, as another feature of this invention, the threaded fit between adjusting shaft body 72 and threads 24 is designed to allow shaft 71 to be rotated relative to deflector body 40 for adjustment. Thus, if deflector body 40 is immobilized at the position corresponding to the maximum arc of coverage, and a tool is engaged in adjusting slot 74, the axial position of valve member 73 can be adjusted. This can be done during assembly at the factory to provide nozzles of different precipitation rates for the same range of coverage with the same parts.

The proportional flow control and the ability to preset a full arc of coverage position for throttling valve 36 is an important improvement over existing designs.

The slope of deflector body 40 primarily determines the spray range. Thus, a complete sprinkler system having nozzles with one predetermined precipitation rate for different spray ranges can be assembled from common parts except for interchangeable deflector bodies 40. Filter 90 (even if the upper end serves as the body of throttling valve 36) may be a common part with precipitation rate adjusted by pre-positioning adjusting shaft 71 and flow control head 73.

The illustrated construction allows slots 80 each to be larger than the openings 92 in filter 90. In contrast, a continuous slot surrounding the outer circumference of valve member upper portion 82 would have to be narrower that the filter opening for short range nozzles and would consequently be more likely to be obstructed by dirt. Compensation for this by using a filter with smaller openings would only make the filter more prone to obstruction.

Even though the spray nozzle range can be somewhat reduced by a smaller spray deflector elevation angle, if the flow rate is not also reduced, the precipitation rate would be very high for the reduced area of coverage, and the spray angle would have to be reduced to flat or inverted unless the flow is throttled upstream or the adjustable arc discharge slot is made small, (i.e. 0.010 in.) for some of the shortest ranges desired. Reducing the range in half, for example, reduces the flow rate for the same precipitation rate by a factor of four.

Figure 2:
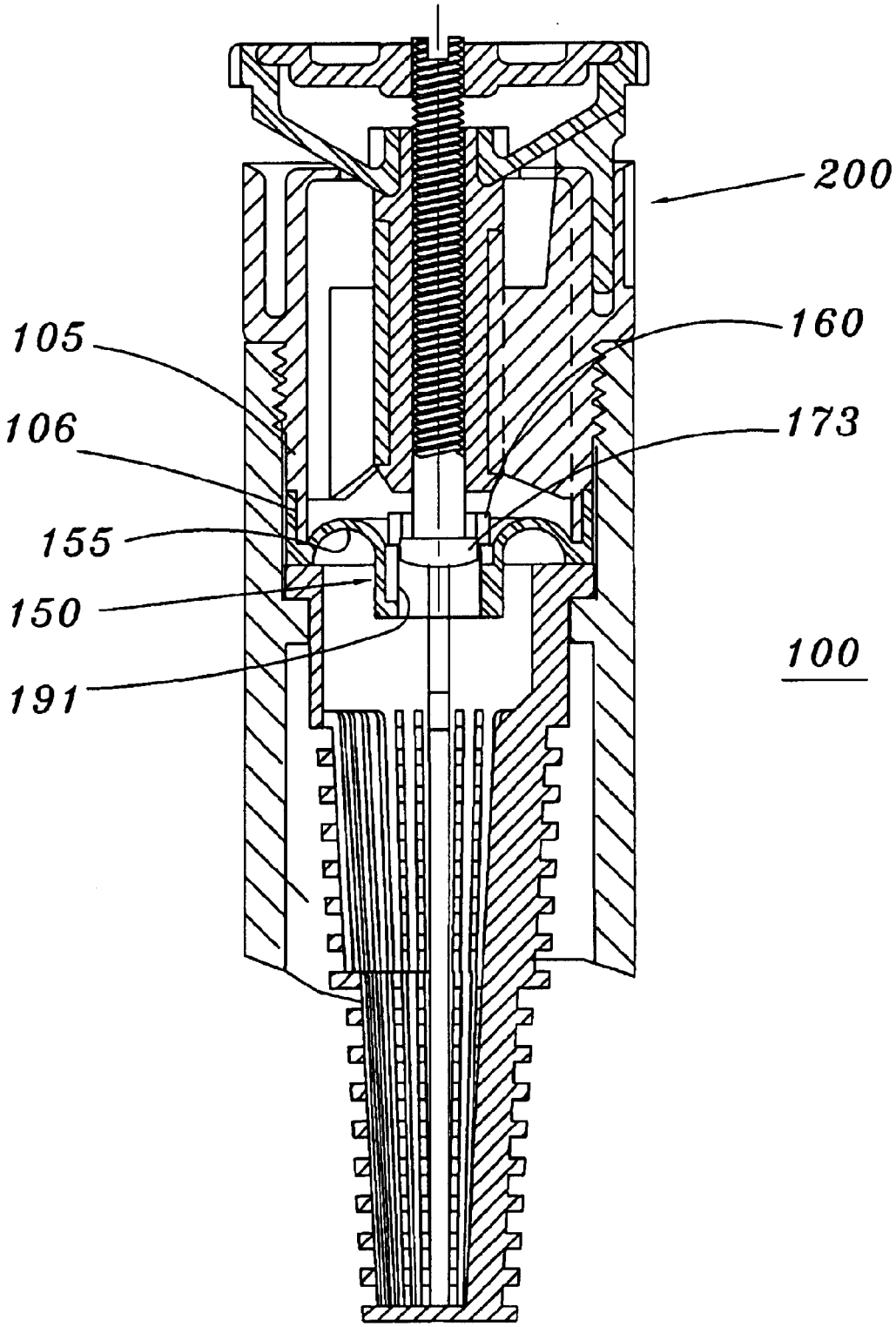
FIG. 2 is a cross-sectional view similar to FIG. 1 showing a second embodiment of the invention, in which the upstream throttling valve includes a flexible stator member to provide pressure compensation.

FIG. 2 illustrates a modified embodiment of the arc settable spray nozzle of this invention. The modified nozzle, generally denoted at 100 is similar to the embodiment previously described except that the upstream throttling valve is formed by valve member 173 and the valve body is formed by a resilient pressure compensating diaphragm 150 which is snap attached to the bottom end of the spray nozzle body 105 at 106. Member 150 includes an axial slot 191 which functions as an outlet orifice.

Pressure compensating member 150 includes a folded area 155. The structure deflects in response to increased inlet water pressure, thereby reducing the throttling slot opening. By properly selecting the thickness and rigidity of folded area 155, the changes in the size of the throttling slot opening can compensate for pressure variations by their axial position and thus help keep the flow more constant at elevated inlet pressures. Ribs 160 may be provided to keep the pressure compensating member 150 from being excessively deflected which might totally shut off the flow at very high pressure.

Although the present invention has been described in relation to particular embodiments thereof, many other variations and modifications and other uses will become apparent to those skilled in the art. the scope of the present invention is therefore not intended to be limited not by the specific disclosure herein.

What is claimed is:

1. An adjustable arc of coverage spray nozzle comprising:

an arcuate outlet slot;

an adjustable flow control member that cooperates with the outlet slot to establish the arc of coverage and the spray exit angle; and a flow throttling valve located upstream of the outlet slot, the throttling valve being mechanically coupled tote flow control member for proportional adjustment of the flow rate to maintain a substantially uniform precipitation rate as the arc setting is varied by the flow control mechanism.

2. A spray nozzle as described in claim 1, wherein:

the upstream throttling valve is comprised of a housing including a plurality of outlet slots that extend generally in the direction of flow of water through the nozzle;

and the configurations of the slots and the flow control member are selected according to the flow rate range desired for the nozzle, and to provide flow rate adjustment which is proportional to the adjustments of the arc of coverage setting to provide an approximately constant range of spray coverage and precipitation rate as set during the change of arc setting.

3. A sprinkler system comprising a plurality of spray nozzles as described in claim 2, wherein the throttling valve is adjustable relative to the flow control member so that a flow rate for maximum arc of coverage corresponds to the precipitation rate for the nozzle.

4. A fixed range spray nozzle having an adjustable arc of coverage comprising:

a housing including an arcuate spray opening;

a flow control mechanism that is adjustable to vary the size of the spray opening to set the arc of coverage of the nozzle;

a flow throttling valve located upstream of the arcuate slot to control the flow rate for the nozzle, the flow throttling valve being comprised of:

a body having an inlet region and an outlet orifice region; and a valve member that is positionable to vary the flow through the outlet orifice region, the configuration of the outlet orifice region being such as to concentrate the flow out of the throttling valve into a small number of exit slots to allow keeping the slot open for the delivery of water for delivery to the arcuate slot; and an adjusting member that couples the flow control mechanism and the flow throttling valve member for coordinated adjustment to maintain a substantially constant flow rate per unit area of coverage as the flow control mechanism is adjusted to vary the arc of coverage.

5. A spray nozzle as described in claim 4, wherein the flow control mechanism includes a replaceable deflector portion that cooperates with the arcuate opening to control vertical exit angle at which water exits the sprinkler, the configuration of the deflector determining the range of the nozzle.

6. A spray nozzle as described in claim 5, wherein the configuration of the deflector portion is coordinated with the configuration of the throttling valve outlet orifice region to provide a settable flow rate per unit area of coverage for a plurality of different deflector configurations that can be pre-adjusted during nozzle assembly to provide a known range and settable precipitation rate spray nozzle.

7. A spray nozzle as described in claim 4, wherein the flow control mechanism includes a deflector portion that cooperates with the arcuate opening to control the vertical exit angle at which water exits the sprinkler, the configuration of the deflector determining the range of the nozzle.

8. A spray nozzle as described in claim 4, wherein:

the outlet orifice region of the throttling valve is comprised of a plurality of outlet slots extending generally in a direction corresponding to the direction of flow through the nozzle, and located in the flow path; and the valve member is movable along an axis extending in the flow direction to vary the flow area through the plurality of slots.

9. A spray nozzle as described in claim 4 where the flow is throttled up stream of the arc settable spray nozzle arcuate exit flow slot area proportionally to the arc of coverage setting to provide an approximately constant range of spray coverage independent of the arc of coverage setting and presettable to a desired precipitation rate.

10. A spray nozzle as described in claim 4, further including a filter upstream of the valve outlet orifice region.

11. A spray nozzle as described in claim 10, wherein the filter includes a cavity at the downstream end thereof which forms the body of the flow throttling valve.

12. A spray nozzle as described in claim 4, wherein:

the adjusting member is comprised of a central shaft extending generally in the direction of flow from the water supply through the nozzle, the downstream end of the shaft is connected to the flow control mechanism and is normally movable therewith, the valve member is connected to the upstream end of the shaft and movable therewith, and the shaft is threadedly supported in the housing and is rotationally and axially movable therein.

13. A spray nozzle as described in claim 12, wherein the position of the shaft is axially adjustable relative to the flow control mechanism.

14. A spray nozzle as described in claim 12, wherein the length of the arcuate slot is varied as the flow control mechanism moves with the shaft.

15. A spray nozzle as described in claim 12, wherein the flow area through the exit slots in the valve outlet orifice region is varied by the axial movement of the valve member on the central shaft.

16. A spray nozzle as described in claim 4, wherein the body of the flow throttling valve includes a resilient diaphragm with an axial outlet orifice slot therein.

17. A spray nozzle as described in claim 16, wherein:

the diaphragm includes a circumferentially extending folded area, the folded area being deformable in response to changes in water pressure to change the size of the outlet orifice slot; and the thickness and resiliency of the folded area are selected so that the changes in the size thereof compensate for pressure variations and thus help keep the flow more constant at elevated inlet pressures.

18. A sprinkler system comprising a plurality of spray nozzles as described in claim 4, wherein the flaw control mechanisms and the throttling valve bodies of the respective nozzles have different configurations according to the spray ranges of the individual nozzles.

19. A selected range arc settable spray nozzle including a throttling valve located up stream of an arc settable spray nozzle arcuate exit flow slot area, the throttling valve being operative to proportionally adjust the flow rate according to the arc of coverage setting to provide an approximately constant range of spray coverage independent of the arc setting, wherein throttling valve includes a plurality of slots, the shape of which is designed to be opened proportionally to changes in flow area of the spray nozzle exit area as the arc of coverage is adjusted.

* * * * *